US005626961A

United States Patent [19]

Aneja

[11] Patent Number: 5,626,961

[45] Date of Patent: May 6, 1997

[54] POLYESTER FILAMENTS AND TOWS

[75] Inventor: Arun P. Aneja, Greenville, N.C.

[73] Assignee: E. I. Du Pont de Nemours and Company, Wilmington, Del.

[21] Appl. No.: 642,650

[22] Filed: May 3, 1996

Related U.S. Application Data

[63] Continuation-in-part of Ser. No. 497,499, Jun. 30, 1995, abandoned.

[51] Int. Cl.[6] ..... D02G 3/00

[52] U.S. Cl. ..... 428/397; 428/399

[58] Field of Search ..... 428/397, 399

[56] References Cited

U.S. PATENT DOCUMENTS

| | | | |
|---|---|---|---|
| 3,914,488 | 10/1975 | Gorrafa | 428/397 |
| 4,316,924 | 2/1982 | Minemura et al. | 428/397 |
| 4,634,625 | 1/1987 | Franklin | 428/397 |
| 4,707,467 | 11/1987 | Clark et al. | 428/397 |
| 4,812,361 | 3/1989 | Takemoto et al. | 428/397 |
| 4,916,013 | 4/1990 | Maeda et al. | 428/397 |
| 5,108,838 | 4/1992 | Tung | 428/397 |
| 5,208,106 | 5/1993 | Tung | 428/397 |
| 5,387,469 | 2/1995 | Warren | 428/397 |

*Primary Examiner*—Newton Edwards

[57] ABSTRACT

A new polyester fiber is provided with an improved scalloped-oval cross-section, such as provides advantages in comfort in downstream products, such as fabrics and garments, and in mill-processing, especially in the form of tows that are suitable for processing on the worsted or woollen systems, and their corresponding slivers.

1 Claim, 8 Drawing Sheets

POLYESTER FILAMENTS AND TOWS

CROSS-REFERENCE TO RELATED APPLICATION

This is a continuation-in-part of my application Ser. No. 08/497,499, filed Jun. 30, 1995, now abandoned.

FIELD OF INVENTION

This invention relates to improvements in polyester filaments and tows, and is more particularly concerned with new polyester filaments having an improved scalloped-oval cross-section, and being such as is especially useful in new polyester tow that is suitable for conversion to a worsted or woollen system sliver and downstream processing on such systems, and to processes relating thereto and products therefrom, and having other advantages.

BACKGROUND OF THE INVENTION

All yarns of synthetic fibers, including yarns of polyester fibers, can be classified into two groups, namely (1) continuous filament yarns and (2) spun yarns, meaning yarns of fibers that are discontinuous, which latter fibers are often referred to as staple fibers or cut fibers. This invention provides improvements developed primarily in relation to the latter group of polyester fibers, but such polyester (staple) fibers have first been formed by extrusion into continuous polyester filaments, which are processed in the form of a tow of continuous polyester filaments.

The terms "fiber" and "filament" are often used herein inclusively, without intending that use of one term should exclude the other.

This invention was developed primarily to solve problems encountered in relation to tows of continuous polyester filaments as it has been desirable to provide a capability of better processing downstream on the worsted system than has existed for polyester tows that have been available commercially heretofore. As will be seen hereinafter, the solution I have provided to the problems that I have encountered is a new polyester filament of unique cross-section that is conveniently referred to often herein as "scalloped-oval" or "hexachannel scalloped-oval." My new polyester filaments have also shown advantages in other applications.

Mostly, the objective of synthetic fiber producers has been to replicate advantageous properties of natural fibers, the most common of which have been cotton and wool fibers. Most commercial polyester cut fiber has heretofore been blended with cotton. A typical spun textile yarn contains about 140 fibers of 1.5 dpf (denier per filament, explained hereinafter) and 1.5 inch length in its cross-section (of cotton count 25). Polyester worsted yarns are different, with fibers that have been of 4 dpf and 3.5 inch length, typically being of worsted count 23, and of cross-section containing about 60 fibers for single yarn and about 42 fibers for bi-ply yarn; the denier and length may vary up to about 4.5 and down to about 3, and the yarn count may vary over 55 worsted to 10 worsted. It is only relatively recently that the advantages of using synthetic fibers of dpf lower than the corresponding natural fibers (such as wool) have been found practical and/or been recognized. Recent attempts to provide low dpf polyester fiber for blending with wool on the worsted system have not, however, been successful, and require improvement. As the fiber denier has been reduced, the fibers have become harder to process (carding, drafting, gilling, etc.) in the mill. In fact, below a certain fiber denier, the commercially-available polyester fibers that I have tried have been practically impossible to process on the worsted system, and/or have given poor quality fabrics. Thus, for commercially-acceptable processing and blending with wool in practice, I have found that the fiber denier of such polyester fibers has had to be a minimum of about 3 dpf. Tows of (nominal) dpf less than 3 are not believed available commercially at this time. This has been the status so far in the trade. Thus far, trying to manipulate a desire to reduce dpf has appeared to be contradictory or incompatible with satisfactory mill processibility.

Processing on the worsted system is entirely different from most practice currently carried out on the cotton system, which generally uses cotton fiber that is sold in bales and that may be mixed with polyester fiber that is primarily staple or cut fiber, that is also sold in compacted bales. In contrast, for processing on their system, worsted operators want to buy a tow of polyester fiber (instead of a compacted bale of cut fiber) so they can convert the tow (which is continuous) into a continuous sliver (a continuous end of discontinuous fibers, referred to hereinafter shortly as "cut fiber") by crush cutting or stretch-breaking. This sliver is then processed (as a continuous end) through several stages, i.e., drafting, dyeing, back-washing, gilling, pin-drafting and, generally, finally blending with wool. It is very important, when processing on the worsted system, to maintain the continuity of the sliver. Also, however, it is important to be able to treat the cut fiber in the sliver appropriately while maintaining a reasonably satisfactory processing speed for the continuous sliver. As indicated, recent attempts to use desirable polyester tow, e.g., with low dpf, have not produced desired results. For instance, unsatisfactorily low machine productivity rates have been required after dyeing; I believe this may have been because such polyester fiber has previously packed together too tightly.

SUMMARY OF THE INVENTION

According to one aspect of the invention, there is provided a filament having a scalloped-oval peripheral cross-section that is of aspect ratio (A:B) about 3:1 to 1.1:1, B being maximum width and A being measured along major axis of the scalloped-oval peripheral cross-section, and having 6 grooves extending along the filament, 3 of said 6 grooves being located on each side of the major axis, 4 of said 6 grooves being located towards the ends of the major axis and being referred to herein as outer grooves, wherein a pair of said outer grooves that are located at the same end of the major axis define between them a lobe at that same end of the major axis and are separated from each other by a minimum distance between said pair of $d_1$, the width of the cross-section as measured at the lobe being $b_1$, and remaining 2 of said 6 grooves that are not outer grooves being located between outer grooves on a side of the major axis and being referred to herein as inner grooves, wherein said inner grooves are separated from each other by a minimum distance between them of $d_2$, wherein bulges in the generally oval peripheral cross-section are defined by being between one of said inner grooves and one of said outer grooves, the width of the cross-section as measured at such bulge being $b_2$, and wherein the numerical relationships between the widths $b_1$ and $b_2$ and the distances $d_1$ and $d_2$ are as follows: $d_1/b_1$ is about 0.5 to about 1; $d_2/b_2$ is about 0.5 to about 0.9; and $b_1/b_2$ is about 0.25 to about 0.9. This improved cross-sectional configuration with 6 grooves is often referred to herein as "scalloped-oval." As indicated, the term "filament" is used inclusively herein. The term is used to include both continous filaments and cut fibers.

This invention is primarily addressed to solving problems encountered in providing polyester filaments (suitable for tow processing in worsted or woollen systems) as already indicated. However, the advantages of the unique cross-sectional configuration of my new filaments may well also be adaptable to other synthetic filaments, e.g., of polyamides or polyolefins, by way of example.

According to a further aspect of the invention, I provide a polyester tow of such new filaments for processing on the woollen or worsted system. Polyester tow is usually sold in large tow boxes.

It is in the downstream products and in processing on the worsted system that the advantages of the invention are mainly demonstrated, as will be illustrated hereinafter. Such advantages are particularly significant for lower dpf "scalloped-oval" fiber products, but improvements are also available for normal dpfs. There are also provided, therefore, such downstream "scalloped-oval" fiber products, according to the invention, especially continuous worsted system polyester (cut) "scalloped-oval" fiber slivers, and yarns, fabrics, and garments from such slivers, including from blends of polyester fiber and of wool fiber and/or, if desired, other fibers, and processes for their preparation and/or use.

As will be described hereinafter, although the invention was derived from solving a problem relating to polyester tow for processing on a worsted system, advantages have been demonstrated in continuous filament yarns of filaments of my new "scalloped-oval" cross-section. So, according to a further aspect of the invention, such continuous filament yarns and their downstream products, such as fabrics and garments, are also provided.

According to further aspects of the invention, there are provided processes for preparing the new filaments and other products. In particular, there is provided a process for preparing a tow of drawn, crimped polyester filaments for conversion into polyester worsted yarns, wherein the tow comprises or consists essentially of polyester filaments of my new cross-section, such process comprising the steps of forming bundles of such filaments from polyester polymer, preferably prepared with a chain-branching agent, and preferably by using radially-directed quench air from a profiled quench system, of collecting such bundles of filaments, and combining them into a tow, and of subjecting the filaments to drawing and crimping operations in the form of such tow.

DETAILED DESCRIPTION OF THE INVENTION

Figure 1:
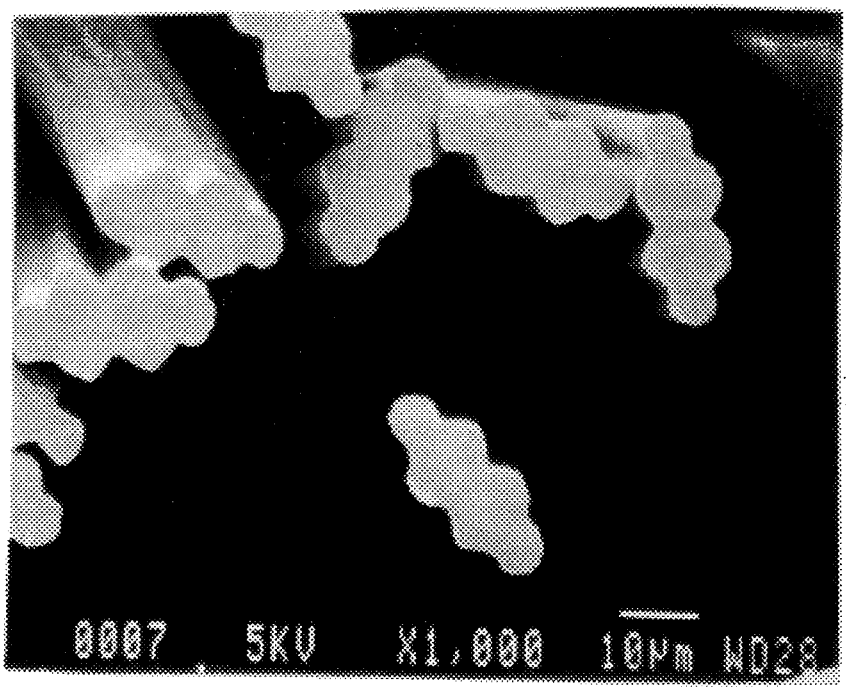
FIG. 1 is a magnified (1000×) photograph of a preferred embodiment of filaments of the invention that have been cut to show their unique scalloped-oval cross-sections with 6 grooves, as well as part of their filament length, as discussed in more detail hereinafter.

As indicated, this invention is concerned primarily with solving problems relating to polyester filament tows that are suitable for processing on the worsted or woollen systems. Presently, such polyester worsted tows as are available commercially are believed to have been bundles of crimped, drawn continuous filaments of round filament cross-section and of denier generally about 900,000, each filament being of about 3 denier. 1 dtex corresponds to 0.9 denier, 1 denier being the weight in grams of 9000 meters of fiber and thus a measure in effect of the thickness of the fiber. When one refers to denier, the nominal or average denier is often intended, since there is inevitably variation along-end and end-to-end, i.e., along a filament length and between different filaments, respectively. In general, it has been the objective of fiber producers to achieve as much uniformity as possible in all processing steps along-end and end-to-end. Most polyester fibers have been of round cross-section. Most have also been of a single denier and of as uniform denier as practical. This is present commercial practice in producing tows for processing on the worsted system. My copending application Ser. No. 08/497,495 (DP-6255), filed Jun. 30, 1995, provides polyester tows of mixed dpf, using filaments of generally oval grooved non-round cross-section, and so its disclosure is hereby expressly incorporated herein by reference.

The cross-sections of the polyester filaments according to my invention should not be round but scalloped-oval, i.e., generally oval in shape with scallops (i.e., with indentations) in the generally oval periphery so as to provide grooves (channels) that run along the length of the filaments. Twenty years ago, a polyester filament of scalloped-oval cross-section having 4 grooves was disclosed by Gorrafa in U.S. Pat. No. 3,914,488, the disclosure of which is hereby expressly incorporated herein by reference. DuPont has made and sold polyester fibers of such 4-grooved-scalloped-oval cross-section (referred to sometimes herein as "4g") for use in continuous filament yarns and staple for processing on the cotton system, but not previously for commercial use on the worsted or woollen systems. To the best of my knowledge and belief, no other fiber producer has sold scalloped-oval polyester fiber for use on the worsted or woollen systems. My scallloped-oval cross-section with 6 grooves is clearly different from the 4-grooved scalloped-oval cross-section disclosed by Gorrafa. As disclosed hereinafter, my scallloped-oval cross-section with 6 grooves provides advantages over Gorrafa's scalloped-oval cross-section. Surprisingly, use of filaments of scallloped-oval cross-section with 6 grooves provides improvements and solves problems mentioned hereinabove in relation to processing of polyester tows on a worsted system.

The essence of the present invention is the cross-sectional shape or configuration of my new filaments that results mainly from selection of appropriately-shaped polymer extrusion orifices, as discussed by Gorrafa, although other factors, such as the polymer viscosity and the spinning conditions, also affect the shape of the filaments. This will now be discussed with reference to the accompanying Drawings. The cross-sectional configuration of filaments according to the invention may be seen in FIG. 1 which is a photomicrograph (1000×) showing actual filament cross-sections as prepared in Example 1.

Figure 2:
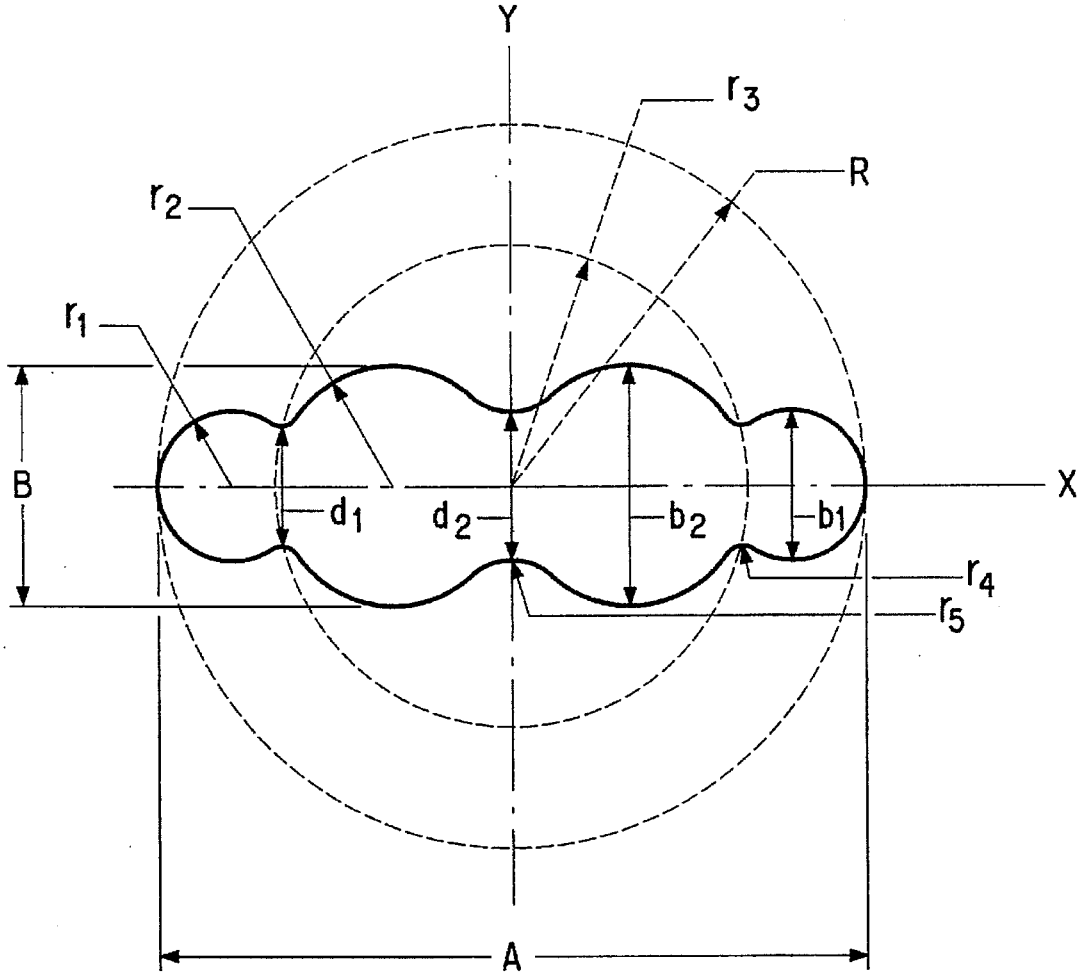
FIG. 2 is a schematic representation of such a cross-section to illustrate calculations of dimensions.

FIG. 2 is a schematic representation of a typical scallloped-oval cross-section with 6 grooves for ease of discussing some dimensions that may be significant. The largest dimension A of the periphery of the fiber cross-section is shown extending along the major axis (x). The maximum width (B) of the fiber cross-section extends parallel to the minor axis (y). The ratio of A to B is referred to as the aspect ratio (A/B). This aspect ratio should generally be up to about 3:1, and at least about 1.1:1 (corresponding to a B/A ratio of about 0.35 to about 0.9); a preferred aspect ratio has been found to be about 2:1. As can be seen, the cross-section has a generally oval periphery that is indented and is to this extent somewhat similar to the prior (4 groove) scalloped-oval cross-section disclosed 20 years ago by Gorrafa. Unlike Gorrafa's 4 groove scalloped-oval, however, this periphery has six (6) indentations (which correspond with 6 channels, or grooves, that extend along the filament length). Three (3) grooves (indentations) are located on either side of the cross-section, i.e., on each side of the major axis (x). Four (4) of the six grooves (indentations) are referred to as "outer" grooves (indentations) as they are located towards the ends of the major axis (x), so a pair of these outer grooves is located, one on either side of, near each end and this pair defines a lobe at each end. This lobe is of width $b_1$, measured generally parallel to the minor axis (y). Such a pair of outer grooves at the same end of the major axis (x) is separated one from the other by a distance $d_1$, also shown as being in a direction parallel to the minor axis (y) because the grooves are shown symmetrically located. It will be understood that if the indentations are not opposite one another (as in some of the cross-sections shown in FIG. 5), the separation distance $d_1$ will not be precisely parallel to the minor axis (y). The remaining grooves on either side of the major axis are located between these outer grooves and are referred to accordingly as "inner" grooves (indentations). Such grooves in the generally oval (i.e., generally convexly-curved) periphery define (between adjacent grooves along a side of the cross-section) what are referred to herein as "bulges"; these may be considered somewhat similar to what Gorrafa referred to as his lobes that he located on each extremity of his minor axis, but are probably more correctly termed bulges than lobes. Because preferred filaments of the present invention are improved scalloped-oval filaments, whose cross-sections have six (6) grooves, in contrast to Gorrafa's four (4), my cross-sections have three (3) grooves on either side and two (2) bulges on either side; more could be provided, but these numbers are preferred in practice. The width of a bulge is designated $b_2$ (corresponding to the width of a lobe, namely $b_1$) and a pair of inner grooves is separated from each other (across the major axis) by $d_2$ (corresponding to the separation between a pair of outer grooves by distance $d_1$). As will be understood, the maximum width of a bulge is B, namely the maximum width of the filament cross-section.

The numerical relationships of the foregoing parameters should be approximately as follows:

A/B—3 to 1.1—preferably 2;

$d_1/b_1$—0.5 to 1.0—preferably 0.58;

$d_2/b_2$—0.5 to 0.9—preferably 0.61;

$b_1/b_2$—0.25 to 0.9—preferably 0.5.

As can be seen in FIG. 2 and as described by Gorrafa, some aspects of the peripheral cross-section of the filament can be described by circumscribing circles, for instance a tip radius $r_1$ of a lobe at the extremity of the major axis (x); this is because the polymer tends to flow to produce smooth curves in the periphery. The length A of the cross-section can be described as 2R, where R is the radius of a circumscribing circle, and the location of the outer grooves can be considered as approximately on an arc of a circle of radius $r_3$, as shown in FIG. 2. Similarly the periphery of a bulge can be described as an arc of a circle of radius $r_2$, and the outer and inner grooves as concave arcs of radius $r_4$ and $r_5$, respectively, if desired. The ratio of radius $r_3/R$ is preferably about 0.5, values measured as in some of the Examples being from about 0.45 to about 0.67, and may be, for instance, from about 0.25 to about 0.75.

Figure 5:
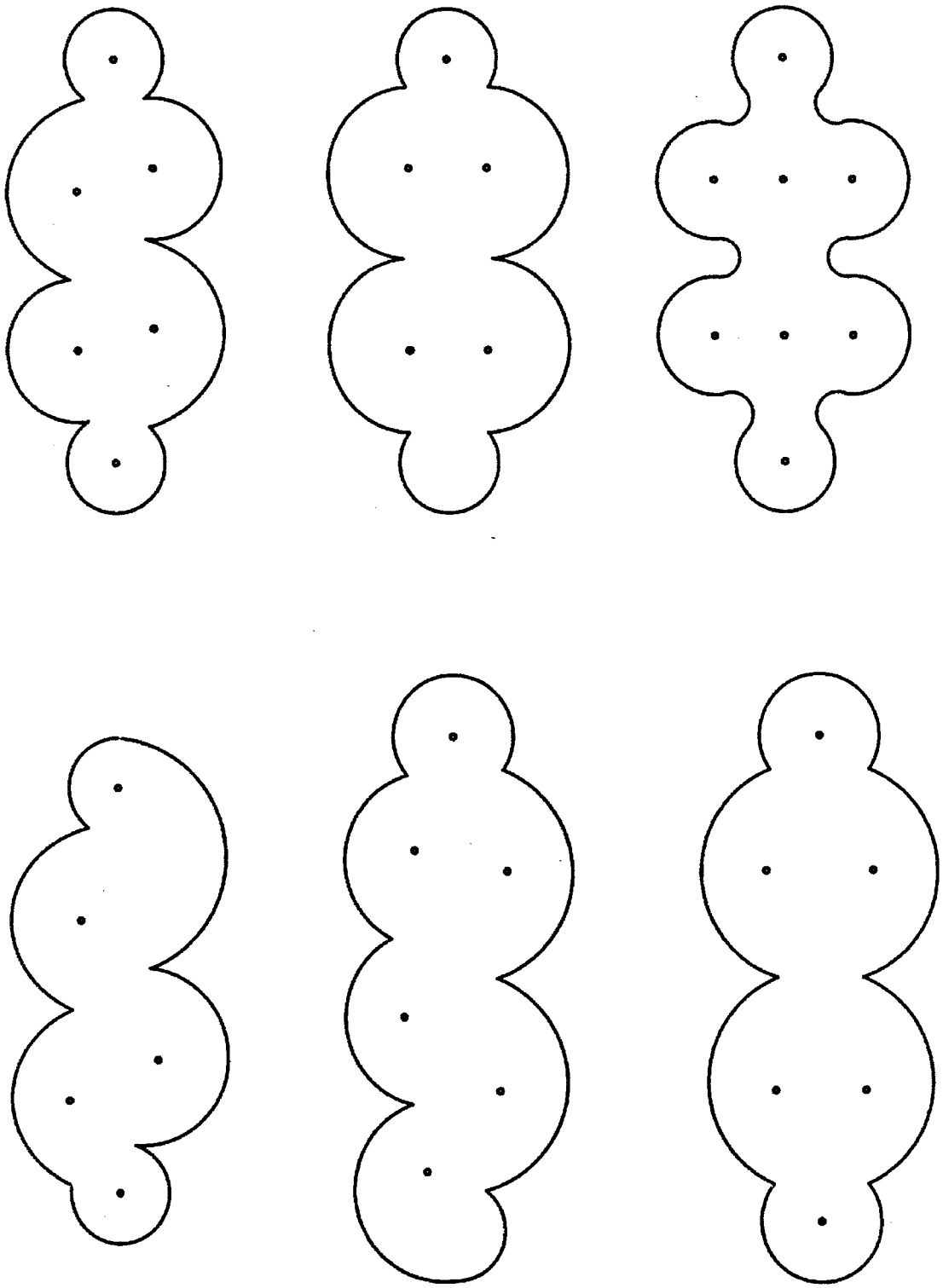
FIG. 5 shows schematic representations of various cross-sections for filaments of the invention, and include one pentachannel cross-section.

Various alternative improved scalloped-oval cross-sections can be envisaged for filaments of this invention and are shown in FIG. 5. As can be seen from some of the alternatives in FIG. 5, the indentations need not be symmetrically located opposite each other on either side of the filament. Indeed, as shown at bottom left, a pentachannel configuration can be envisaged with three channels on one side and only two on the other. More than six channels can also be envisaged, but may be less preferred.

Figure 3:
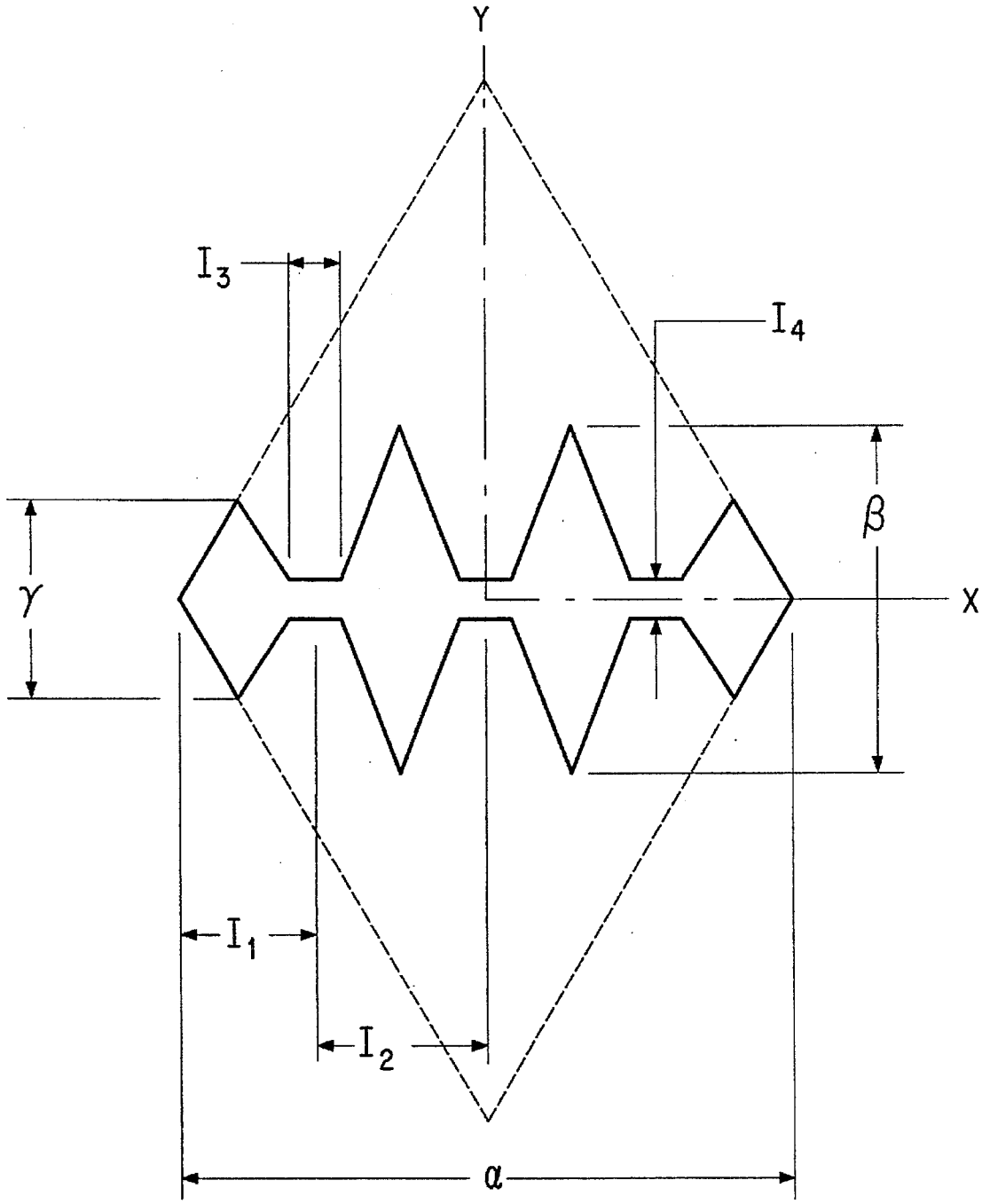
FIG. 3 is a schematic representation of a preferred spinneret capillary orifice used to spin filaments of the invention.
Figure 4:
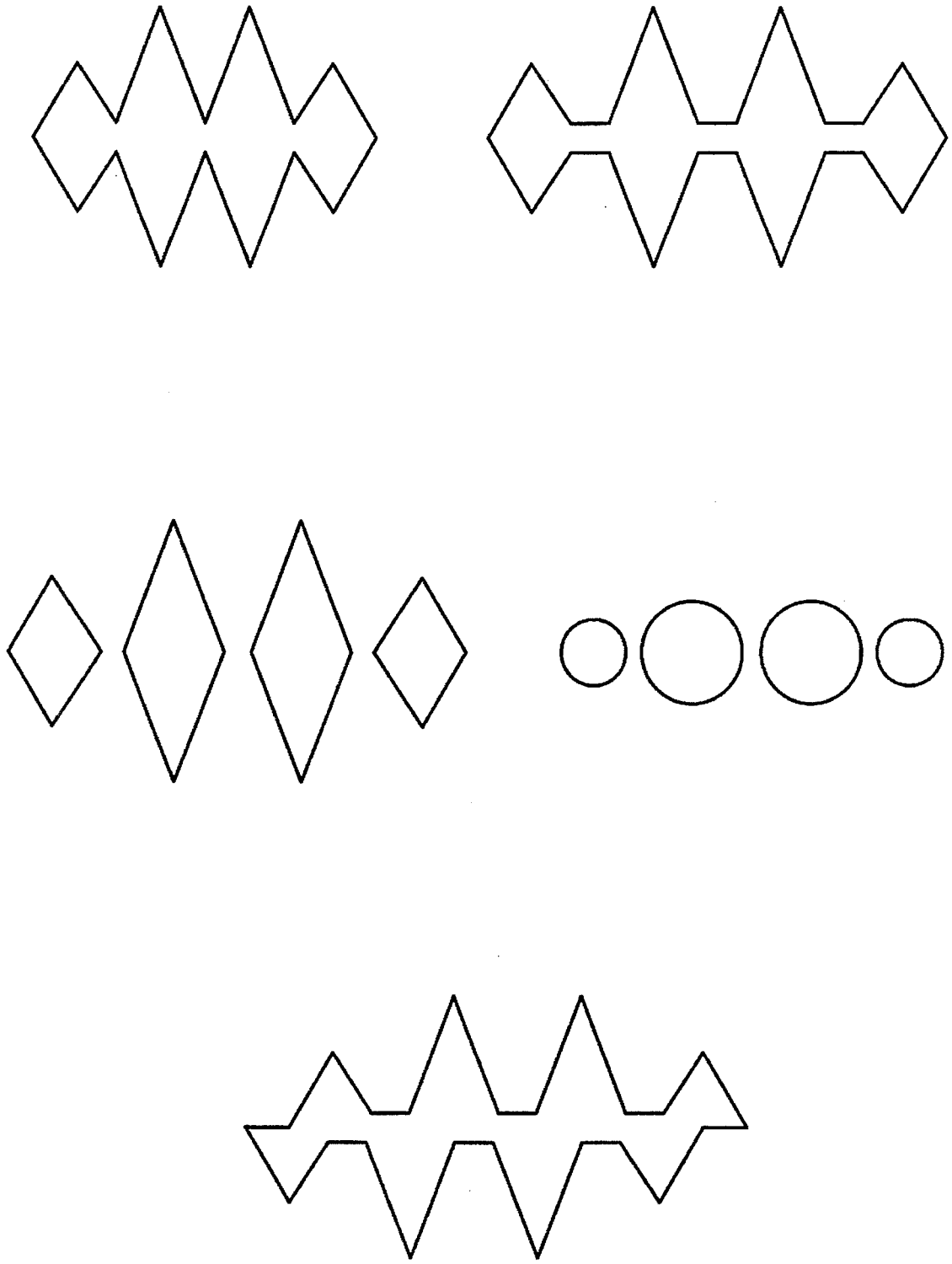
FIG. 4 shows schematic representations of other spinneret capillary orifices for spinning filaments of the invention.

Spinneret capillary orifices preferred for preparing filaments of the invention are shown in FIGS. 3 and 4 and are described in greater detail in the Examples hereinafter, as are other details of processes of preparation.

The polyester polymer used to make the filaments is preferably chain-branched, as indicated in Example I. This technology has long been disclosed in various art, including Mead and Reese U.S. Pat. No. 3,335,211, MacLean et al. U.S. Pat. Nos. 4,092,299 and 4,113,704, Reese U.S. Pat. No. 4,833,032, EP 294,912, and the art disclosed therein, by way of example. Tetraethylsilicate (TES) is preferred as chain-brancher according to the present invention. The amount of chain-brancher will depend on the desired result, but generally 0.3 to 0.7 mole % of polymer will be preferred. The polyester polymer should desirably be essentially 2G-T homopolymer (other than having chain-brancher content), i.e., poly(ethylene terephthalate), and should preferably be of low relative viscosity, and polymers of LRV about 8 to about 12 have been found to give very good results as indicated hereinafter in the Examples; the relative viscosity (LRV) is defined in Broaddus U.S. Pat. No. 4,712,988. As disclosed by Mead and Reese, an advantage of using TES is that it hydrolyzes later to provide a desirable low pilling product. However, use of radially-directed quench air from a profiled quench system as disclosed by Anderson et al. in U.S. Pat. No. 5,219,582 is preferred, especially when spinning such low viscosity polymer. As also indicated in the Examples, copolymers (polymers with comonomeric units) of ethylene terephthalate may be used instead of 2G-T homopolymer, cationic-dyeable copolyester fibers having desirable low pilling characteristics having been used.

Variations in the polymers and filaments, and in their preparation and processing will often depend on what is desirable in downstream products, such as fabrics and garments. Aesthetic considerations are very important in apparel and other textile applications. Worsted apparel applications include, for example, men's and women's tailored suits, separates, slacks, blazers, military and career uniforms, outerwear and knits.

As indicated hereinafter and in the Background hereinbefore, tows of the invention (including their resulting slivers) may be processed with advantages on the worsted system. Typical process preparation steps are described hereinafter in Example I. Crimping and drawing and most other product and processing conditions and characteristics have been described in the art, e.g., that referred to.

EXAMPLES

The invention is further illustrated in the following Examples, which, for convenience, refer to processing on the worsted system, which is generally more important, but the tows of the invention could also be processed on a woollen system. All parts and percentages are by weight unless otherwise indicated. Most test procedures are well known and/or described in the art. The values were measured conventionally with reference to denier and are recorded as such in the Examples, especially the Tables (but SI values, with reference to dtex, have been given thereafter in parentheses).

For avoidance of doubt, explanation of procedures that I used are given in the following paragraphs.

Figure 6:
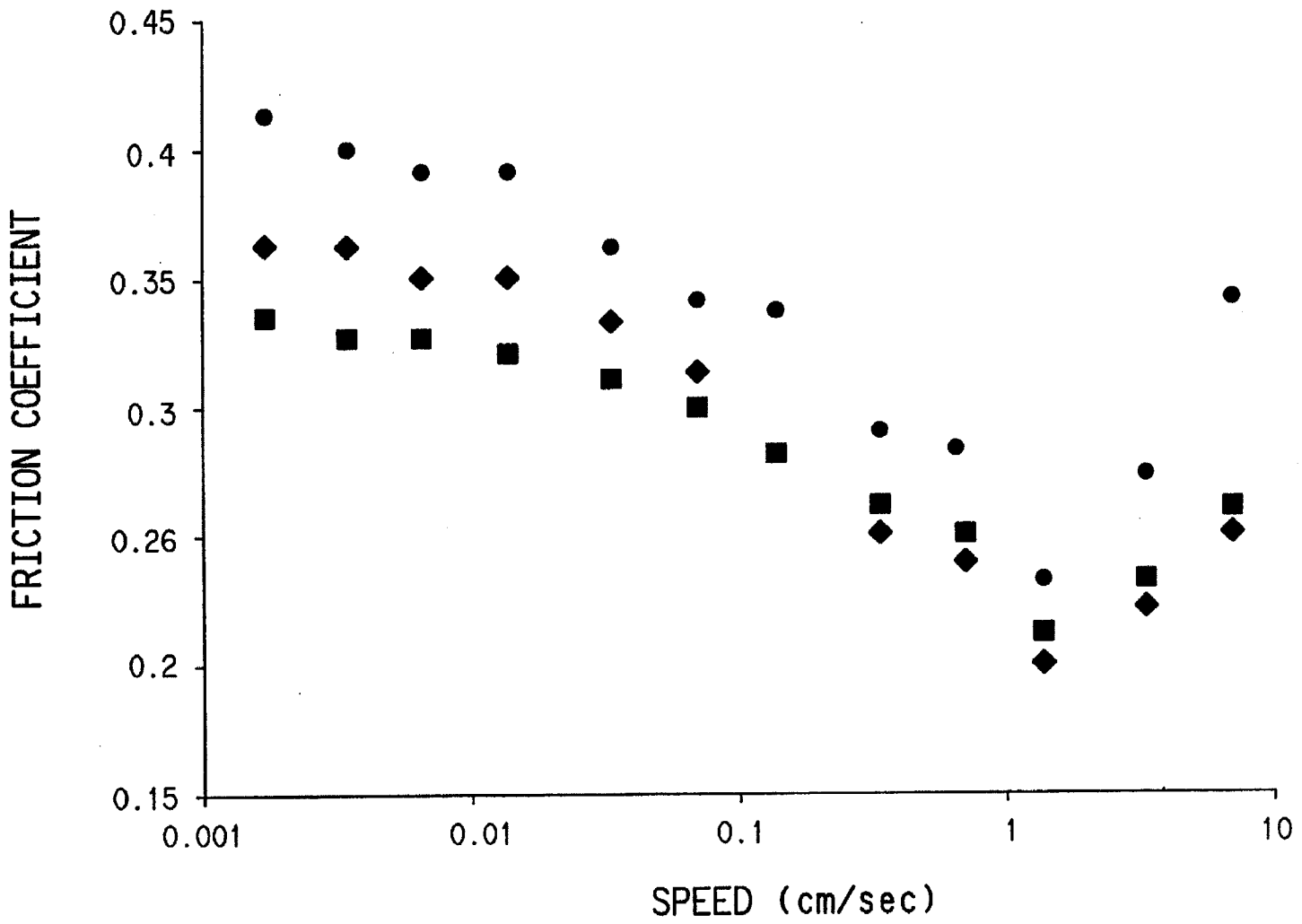
FIGS. 6–8 show various curves that have been plotted to illustrate aspects and advantages of the invention, as are explained hereinafter.
Figure 7:
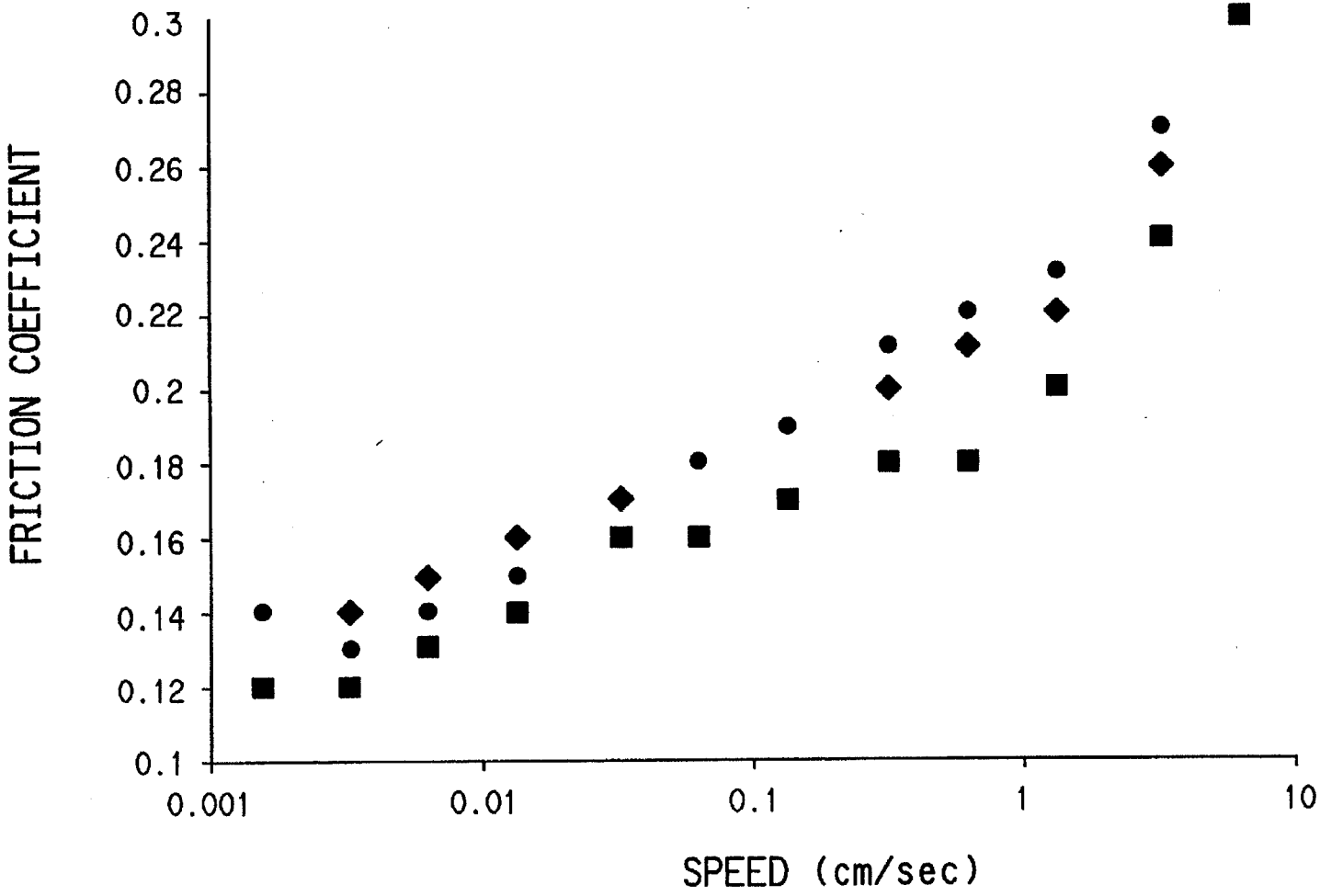

The fiber frictions are obtained using the following procedure. A test batt weighing 0.75 gram is made by placing fibers on a one-inch wide by 8-inch long adhesive tape. For fiber-to-fiber friction measurements, 1.5 grams of fibers are attached to a 2-inch diameter tube that is placed on a rotating tube on the mandrel. One end of the test batt is attached to a strain gauge and draped over the fiber-covered mandrel. A 30-gram weight is attached to the opposite end and tensions are measured as the mandrel rotates at various speeds over a range of 0.0016–100 cm/sec. When fiber-to-metal friction is measured, a smooth metal tube is used instead of the tube covered with 1.5 grams of fibers, but the procedure is otherwise similar. The coefficients of friction are calculated from the tensions that are measured. FIGS. 6 and 7 plot the coefficients of friction vs. speed (cm/sec.) for fiber-to-fiber friction and for fiber-to-metal friction, respectively, for 3 dpf fibers, as explained at the end of Example I.

The fiber cross sections were obtained using the following procedure. A fiber specimen is mounted in a Hardy microtome (Hardy, U. S. Department of Agriculture circ. 378, 1933) and divided into thin sections according to methods essentially as disclosed in "Fiber Microscopy Its Technique and Applications" by J. L. Sloves (van Nortrand Co., Inc., New York 1958, No. 180–182). Thin sections are then mounted on a super fiberquant video microscope system stage (Vashaw Scientific Co., 3597 Parkway Lane, Suite 100, Norcross, Ga., 30092) and displayed on the Super Fiberquant CRT under magnifications as needed. The image of an individual thin section of one fiber is selected and critical fiber dimensions measured. Using the Fiberquant results, aspect ratio, lobe ratio and groove ratio are calculated. The process is then repeated for each filament in the field of view to generate a statistically significant sample set.

Wicking rate is the ability of a material to pick up or carry water by capillary action. Hence, this measurement is regarded as a key component of comfort features (perspiration transport) in fabrics. The test consists of suspending 7-inch (18 cm) long samples vertically in distilled water that is 1 inch (2.5 cm) deep, and the distance that the water has traveled up the specimen is measured at specified time intervals, and these distances are plotted against the time that has elapsed over a period of 30 minutes.

Example I

Filaments of poly(ethylene terephthalate) were melt-spun at 282° C. from polymer containing 0.40 mole percent tetraethyl orthosilicate (as described in Mead, et al. U.S. Pat. No. 3,335,211) and having a relative viscosity of 10.1 (determined for a solution of 80 mg of polymer in 10 ml of hexafluoroisopropanol solvent at 25° C.). The polymer was extruded at a rate of 73.4 lbs./hr. (33.3 kg/hr.) through a spinneret having 450 capillaries. A plan view of the capillary is shown in FIG. 3. As shown, the capillary consists of four diamonds joined by channels to obtain a well-defined filament shape, good spinning performance and low fiber fibrillation propensity. The height (β) of each large diamond-shaped orifice measured along the face of the spinneret and parallel to the y-axis was 21.1 mil (536μ) and the other dimension shown ($I_2$, along the x-axis) was 9.1 mil (231μ). The two small diamond-shaped orifices located on either side of the large ones were each 12.6 mil (320μ) high (γ, parallel to the y-axis) and 8.4 mil (213μ) ($I_1$) along the x-axis. The four diamonds in each cluster were interconnected by three channels. The connecting channels were 2 mil (50μ) high ($I_4$, parallel to y-direction) and 4.76 mil (121μ) long ($I_3$) along x-axis, it being understood that the lengths ($I_3$) of the channels along the x-axis are included already in calculating the dimensions ($I_2$ and $I_1$) of the four diamonds, as shown in FIG. 3. All four diamonds were located in a straight row with the longest dimensions (height) parallel as indicated in FIG. 3. The overall length (α) of the orifice (along the x-axis) was about 35 mil (890μ). Filaments produced from the 450 capillary spinneret were wound at 1600 yards/minute (1460 meters/minute) after being quenched using radially-directed air from a profiled quench system, as described in Anderson, et al. U.S. Pat. No. 5,219,582. The bundle of filaments wound-up was of 3420 denier (3800 dtex) with 450 filaments (7.6 denier per filament, 8.4 dtex). The physical properties are given in Table A.

About 37 ends were combined to produce tow. The tow was drawn 3× in 95° C. spray draw of water. The tow was then passed through a stuffer box crimper to provide about 8 crimps per inch (about 3.1 crimps per cm) and to obtain tow having 47754 denier (2.9 dpf, 53060 dtex, 3.2 dtex/filament). The drawn tow properties are recorded in Table B. The drawn filaments had scalloped-oval cross-section with 6 grooves (as shown in FIG. 1) with the following parameters:

$A/B=2$, $d_1/b_1=0.87$, $d_2/b_2=0.61$, $b_1/b_2=0.50$.

Properties of tows are also given in both Tables for commercially-available round filaments (R) and for 4 groove scalloped-oval cross-section (4g) filaments (as described by Gorrafa in U.S. Pat. No. 3,914,488) for comparison and show that these properties are comparable (so one could have expected their abilities to be processed on a worsted system to be comparable).

TABLE A

| XS | ROPE DEN (DTEX) | SPUN DPF (DTEX) | MOD | TEN | ELONG % | A/B |
|---|---|---|---|---|---|---|
| R | 3967(4408) | 7.6(8.4) | 19(17) | 0.7(0.6) | 325 | 1 |
| 4 g | 3420(3800) | 7.6(8.4) | 20(18) | 0.6(0.5) | 275 | 1.5 |
| EX I | 3420(3800) | 7.6(8.4) | 29(26) | 0.7(0.6) | 300 | 2.0 |

TABLE B

| XS | DR | TOW DEN | DRAWN DPF (DTEX) | MOD | TEN | ELONG % | CPI |
|---|---|---|---|---|---|---|---|
| R | 3X | 47475 (52750) | 2.9(3.2) | 49(44) | 2.5(2.3) | 15 | 8 (3.1) |
| 4 g | 3X | 47328 (52590) | 2.9(3.2) | 52(47) | 2.5(2.3) | 17 | 8 (3.1) |
| EX I | 3X | 47754 (53060) | 2.9(3.2) | 52(47) | 2.5(2.3) | 16 | 8 (3.1) |

The fibers in these tow bundles were processed on the worsted system in the mill. The fibers with round cross sections (R) were hard to process due to unacceptably high levels of fiber-to-fiber and fiber-to-metal friction during various pin drafting stages, i.e., the friction which is generated when a fiber surface slides on another surface. When fibers of scallloped-oval cross-section with 6 grooves according to Example 1 were processed, however, this problem was not encountered. The fibers with 4 groove scalloped-oval (4g) cross-sections processed somewhat better than the round fibers, but were inferior to those of the invention.

The fiber friction characteristics of those fibers are compared in FIGS. 6 and 7, for fiber-to-fiber friction and for fiber-to-metal friction, respectively. Values for the fibers of the invention are plotted as squares, in contrast to those for round (R) fibers (plotted as circles) and for 4 groove (4g) fibers (plotted as diamonds).

Example II

Figure 8:
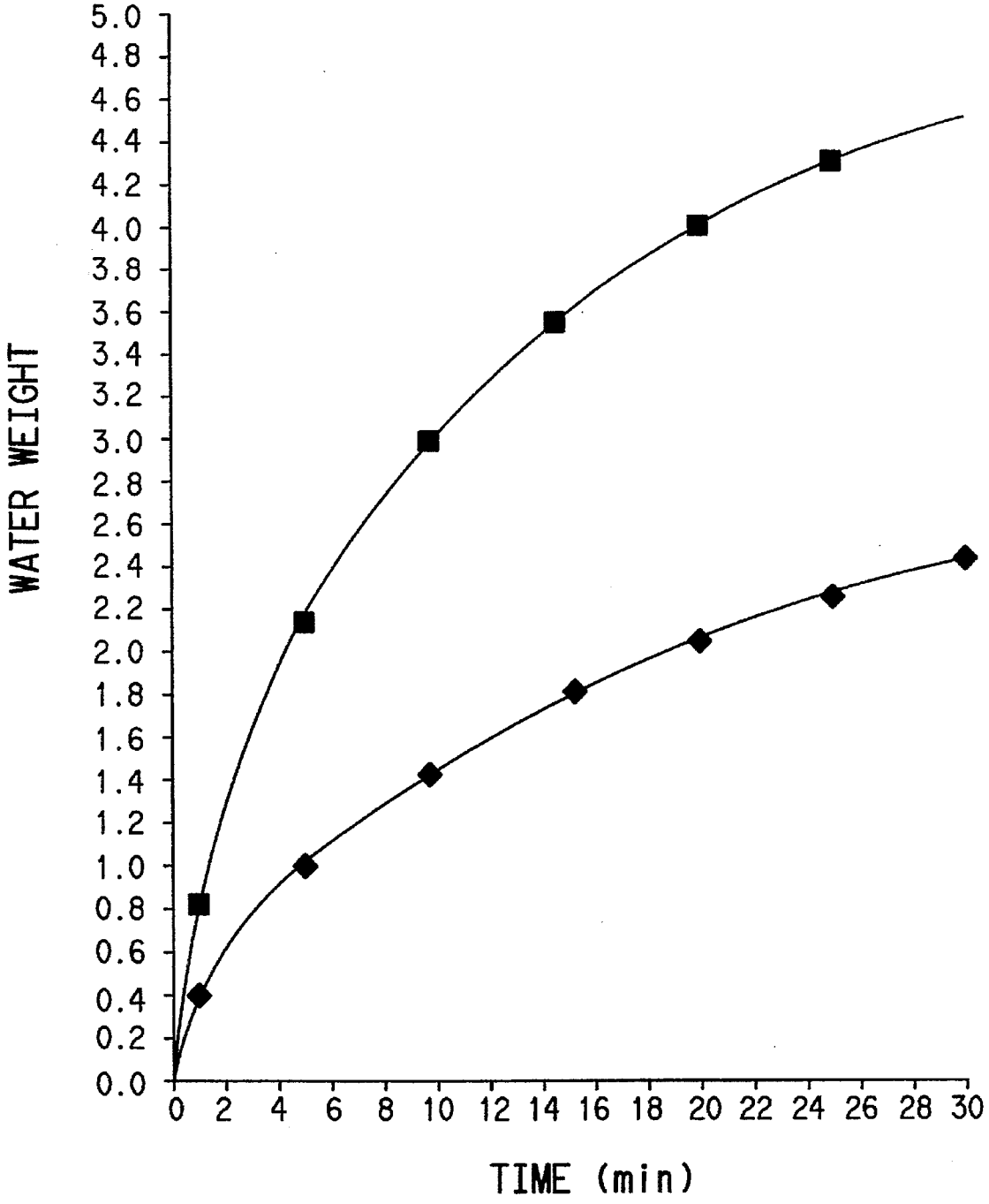

A 70-denier (78 dtex), 34-filament cationic-dyeable polyester yarn was melt-spun at 290° C. with 15.2 LRV polymer of 2GT modified with 2% ethylene 5-(sodium sulfo isophthalate) in a coupled spin-draw process (of the type described by Chantry, et al., in U.S. Pat. No. 3,216,187) by spinning at 2143 ypm (1960 meters/min.), drawing 1.4× and winding at 3000 ypm (2743 meters/min.). The orifice capillary is generally similar to that described in Example I, but with the following dimensions. The height (β) of each large diamond-shaped orifice measured along the face of the spinneret was 20.2 mil (513μ) and the $I_2$ dimension was 8.7 mil (221μ). The two small orifices located on either side of the large ones were 11.4 mil (290μ) high and $I_1$ was 7.8 mil (198μ). The connecting channels were 2.5 mil (64μ) high ($I_4$) and 4.0 mil (102μ) long ($I_3$). Two 70 denier (78 dtex) bundles were combined to form a 140 denier (156 dtex) yarn and wound on a bobbin. The yarn properties are given in Table C, after Example III. The yarn was knit into a single jersey fabric stitch and dyed. The resultant fabric properties are given in Table D, also after Example III. Moisture transport (wicking rate) properties were measured on the fabrics and are compared in FIG. 8, where the values for fibers of the invention are plotted as squares, in contrast to values for 4 groove (4g) fibers, plotted as diamonds, and the heights (inches=2.54 cm) are plotted vs. time (in minutes). An advantage of the invention is the improved comfort as reflected by high moisture transport property, in which the fabric of a filament yarn of the invention showed greatly superior moisture transport as compared with a fabric of a 4 groove scalloped-oval (4g) filament yarn, used as a control.

Example III and Comparisons

Coupled spin-draw filament yarns were spun using three different types of capillary design but were otherwise prepared as in Example II. As will be seen, although all three of these filaments had six grooves in a generally oval peripheral cross-section, only Example III was according to the invention, whereas A and B were comparisons because their cross-sectional dimensions were different. In Example II, the large diamonds of the capillary had a flow area of 111.5 $mil^2$ (71,900$\mu^2$), and the small diamonds had a flow area of 56 $mil^2$ (36,100$\mu^2$), resulting in polymer flow split ratio of 3.55. In Example III, the large diamonds flow area was only 80.6 $mil^2$ (52,000$\mu^2$), while the small diamonds flow area was again 56 $mil^2$ (36,100$\mu^2$), with resultant polymer split ratio of 2.13. In Comparison A, the large diamonds of the capillary had a flow area of 73.7 $mil^2$ (47,500$\mu^2$), and the small diamonds flow area was 52.6 $mil^2$ (33,900$\mu^2$) resulting in a polymer flow split ratio of 2.03. In Comparison B, the large diamonds of the capillary had a flow area of 116 $mil^2$ (74,800$\mu^2$), while the small diamonds had a flow area of 26.8 $mil^2$ (17,300$\mu^2$), with a resultant polymer flow split ratio of 19.0. The spinneret orifices consisted of 34 clusters with four diamonds in each cluster. In each of Comparisons A and B, as shown on the left side at top of FIG. 4, there was no interconnecting channel between the diamonds, while in Examples II and III, all diamonds were interconnected by channels. Other capillary configurations may consist of a cluster of diamonds or circles not even connected to each other but separated by a small distance, as shown on the next line in FIG. 4. The bottom item in FIG. 4 shows a capillary configuration for spinning a cross-section with offset channels.

Physical properties are given in Table C.

Single jersey knit fabrics were prepared and properties were measured, as for Example II, and are given in Table D for Comparisons A and B and for fabrics using filaments of 4-groove (4G) scalloped oval cross-section (as taught in the U.S. Pat. No. 3,914,488) made as a control and from hexachannel ribbon (HR) as another comparison. All five are listed in Table D. As will be seen from Table E, a hexachannel ribbon (HR) cross-section has six grooves but is ribbon-like rather than oval, i.e., the lobes at the extremities of the major axis have the same width as do the bulges that are nearer the inner grooves ($b_1$=$b_2$). An example of such an HR cross-section has been disclosed in U.S. Pat. No. 4,316,924 (Minemura et al.), entitled "Synthetic Fur and Process for Preparation Thereof," in FIG. 1D, and in Examples 1 and 6, which disclose spinning filaments from orifices as shown in FIG. 2D; FIGS. 1J and 1K also show hexachannel ribbon cross-sections that are similar to those in FIG. 1D but have internal voids. All fabrics had the following nominal construction properties: weight about 3.0 oz./sq. yd. (100 gm/$m^2$), wales×courses about 40×32, thickness about 12 mil (300 microns). The fabric comfort related properties are shown in Table D. Fabric obtained from Example II had the best air permeability (1181/1836 cfm dry/wet) and the best moisture vapor permeability (5016 gm/24 hrs./$m^2$). Fabric obtained from Comparison A had lower air permeability (920/1029 cfm dry/wet) and inferior moisture vapor permeability also (3825 gm/24 hrs./$m^2$). It will be noted that fabrics obtained from Comparisons A and B had inferior comfort properties in comparison with those of Example II. The fibers used in Comparisons A and B had large outer groove ratios ($d_1/b_1$) of 1.11 and 1.30, as mentioned previously. The fabric of comparison 4-groove scalloped-oval cross-section filaments (4g) had the next best air permeability (1132/1299 cfm dry/wet) and moisture vapor permeability (4470 gm/24 hrs./$m^2$), better than those for hexachannel ribbon (HR), (1007/1151 dry/wet and 3993 gm/24/hr/$m^2$, respectively).

TABLE C

| | TEN GPD (G/DTEX) | MOD GPD (G/DTEX) | ELONG % | BOS % | INTERLACE NODES/ METER | DRAW TENSION (G) |
|---|---|---|---|---|---|---|
| EXAMPLE | | | | | | |
| II | 2.9(2.6) | 66(59) | 28 | 8.3 | 19 | 242 |
| III | 2.9(2.6) | 64(58) | 30 | 5.9 | 22 | 237 |
| COMPARISONS | | | | | | |
| A | 2.9(2.6) | 64(58) | 33 | 5.7 | 25 | 237 |
| B | 2.7(2.4) | 62(56) | 27 | 8.1 | 23 | 230 |

TABLE D

| | WEIGHT OZ/YD$^2$ (G/M$^2$) | WALES X COURSES | THICK-NESS MIL(μ) | BULK CC/G | AIR PERM. CFM DRY/WET | VAPOR PERM. G/24 HR/M$^2$ |
|---|---|---|---|---|---|---|
| EXAMPLE | | | | | | |
| II | 3.4(115) | 40 × 32 | 12(300) | 3.1 | 1181/1836 | 5016 |
| COMPARISONS | | | | | | |
| A | 3.2(108) | 42 × 33 | 13(330) | 3.1 | 920/1029 | 3825 |
| B | 3.4(115) | 38 × 36 | 13(330) | 2.8 | 1104/1235 | 3004 |
| 4 G | 2.9(98) | 40 × 32 | 12(300) | 3.1 | 1132/1299 | 4470 |
| HR | 3.1(105) | 42 × 33 | 12(300) | 2.9 | 1007/1151 | 3993 |

TABLE E

| RATIOS | ASPECT RATIO A/B | OUTER GROOVE $d_1/b_1$ | INNER GROOVE $d_2/b_2$ | LOBE/BULGE $b_1/b_2$ |
|---|---|---|---|---|
| LIMITS | 3–1.1 | 0.5–1.0 | 0.5–0.9 | 0.25–0.9 |
| PREFERRED | 2 | 0.58 | 0.61 | 0.50 |
| EX. I | 2 | 0.87 | 0.61 | 0.50 |
| EX. II | 2 | 0.93 | 0.61 | 0.50 |
| EX. III | 2.6 | 0.80 | 0.63 | 0.69 |
| COMPARISONS | | | | |
| EX. A | 2.5 | 1.11 | 0.74 | 0.59 |
| EX. B | 1.8 | 1.30 | 0.68 | 0.30 |
| HR | 2.5 | 0.94 | 0.82 | 1.0 |
| 4 g | 1.85 | 0.84 | — | 0.68 |

I claim:

1. A polyester filament having a scalloped-oval peripheral cross-section that is of aspect ratio (A:B) about 3:1 to 1.1:1, B being maximum width and A being measured along major axis of the scalloped-oval peripheral cross-section, and having 6 grooves extending along the filament, 3 of said 6 grooves being located on each side of the major axis, 4 of said 6 grooves being located towards the ends of the major axis and being referred to herein as outer grooves, wherein a pair of said outer grooves that are located at the same end of the major axis define between them a lobe at that same end of the major axis and are separated from each other by a minimum distance between said pair of $d_1$, the width of the cross-section as measured at the lobe being $b_1$, and remaining 2 of said 6 grooves that are not outer grooves being located between outer grooves on a side of the major axis and being referred to herein as inner grooves, wherein said inner grooves are separated from each other by a minimum distance between them of $d_2$, wherein bulges in the generally oval peripheral cross-section are defined by being between one of said inner grooves and one of said outer grooves, the width of the cross-section as measured at such bulge being $b_2$, and wherein the numerical relationships between the widths $b_1$ and $b_2$ and the distances $d_1$ and $d_2$ are as follows: $d_1/b_1$ is about 0.5 to about 1; $d_2/b_2$ is about 0.5 to about 0.9; and $b_1/b_2$ is about 0.25 to about 0.9.

* * * * *